US010608322B2

(12) United States Patent
Bao et al.

(10) Patent No.: US 10,608,322 B2
(45) Date of Patent: Mar. 31, 2020

(54) ANTENNA COMPONENT AND MOBILE TERMINAL HAVING THE SAME

(71) Applicant: GUANGDONG OPPO MOBILE TELECOMMUNICATIONS CORP., LTD., Dongguan (CN)

(72) Inventors: Xiaoming Bao, Dongguan (CN); Maozhao Huang, Dongguan (CN)

(73) Assignee: GUANGDONG OPPO MOBILE TELECOMMUNICATIONS CORP., LTD., Dongguan, Guangdong (CN)

( * ) Notice: Subject to any disclaimer, the term of this patent is extended or adjusted under 35 U.S.C. 154(b) by 261 days.

(21) Appl. No.: 15/681,712

(22) Filed: Aug. 21, 2017

(65) Prior Publication Data

US 2018/0175483 A1 Jun. 21, 2018

(30) Foreign Application Priority Data

Dec. 15, 2016 (CN) ..... 2016 2 1376937 U

(51) Int. Cl.
*H01Q 1/24* (2006.01)
*H01Q 9/06* (2006.01)

(52) U.S. Cl.
CPC ..... *H01Q 1/243* (2013.01); *H01Q 9/065* (2013.01)

(58) Field of Classification Search
CPC ..... H01Q 1/243; H01Q 9/065
See application file for complete search history.

(56) References Cited

U.S. PATENT DOCUMENTS

2009/0315789 A1* 12/2009 Sung ..... H01Q 1/243 343/702
2013/0249744 A1* 9/2013 Jang ..... H01Q 21/30 343/702
2016/0056531 A1* 2/2016 Lee ..... H01Q 7/00 343/702
2016/0218422 A1* 7/2016 Choi ..... H01Q 1/38

FOREIGN PATENT DOCUMENTS

CN 103401059 A 11/2013
CN 105932397 A 9/2016

OTHER PUBLICATIONS

PCT/CN2017/099536 International Search Report & Written Opinion, dated Oct. 30, 2017, 13 pages.

* cited by examiner

*Primary Examiner* — Graham P Smith
*Assistant Examiner* — Jae K Kim
(74) *Attorney, Agent, or Firm* — Lathrop GPM LLP

(57) ABSTRACT

An antenna component includes an antenna body and a conductor. The antenna body includes a PCB board and a spring piece, and a first end of the spring piece is connected to the PCB board. The conductor is configured to be connected to an insulator and an end metal piece, and includes a first conductive portion opposite to the insulator, and a second conductive portion connected to the first conductive portion and opposite to the end metal piece, and the first conductive portion abuts against a second end of the spring piece. A mobile terminal including an antenna component is further provided.

19 Claims, 2 Drawing Sheets

ANTENNA COMPONENT AND MOBILE TERMINAL HAVING THE SAME

CROSS-REFERENCE TO RELATED APPLICATION

This application claims priority to and benefits of Chinese Patent Application Serial No. 201621376937.X, filed with the State Intellectual Property Office of P. R. China on Dec. 15, 2016, the entire content of which is incorporated herein by reference.

FIELD

The present disclosure relates to electronic products, in particular to an antenna component and a mobile terminal having the same.

BACKGROUND

With the popularity of mobile terminals, such as smart phones, and the improvement of metal housing manufacturing process, a metal housing is employed in more and more mobile phones and makes the smart phone more advanced due to its high heat dissipation capacity, high mechanic strength (enabling the metal housing to be thinned so as to meet the need of consumers for ultra-thin equipment), unique metallic luster and fashion appearance. As the metal housing may produce electrostatic shielding effect which affects the emission and reception of radio frequency, the metal housing is generally designed in a three-section manner, in which a body and two end pieces of the metal housing are spaced apart by providing a groove therebetween, and connected to form an integral housing by a plastic injected into the groove and molded therein. In this way, the end piece of the metal housing is connected to the PCB board via a spring piece, such that the end piece possesses a signal radiation function and becomes a part of the antenna.

However, in order to improve the integrity of the metal housing, a width of the end piece of the metal housing narrows down. In such a case, the overall structure of the antenna will become more complex when the spring piece is in direct contact with the end piece, affecting assembly efficiency.

SUMMARY

Therefore, it is necessary to provide an antenna component which simplifies the assembly structure and ensures the radiation function and a mobile terminal having the same.

In an embodiment of a first aspect of the present disclosure, an antenna component is provided. The antenna component includes: an antenna body and a conductor. The antenna body includes a PCB board and a spring piece, and a first end of the spring piece is connected to the PCB board. The conductor is configured to be connected to the insulator and the end metal piece. The conductor includes: a first conductive portion opposite to the insulator, and a second conductive portion connected to the first conductive portion and opposite to the end metal piece. The first conductive portion abuts against a second end of the spring piece.

In an embodiment of a second aspect of the present disclosure, a mobile terminal is provided. The mobile terminal includes a housing and an antenna component. The housing includes an intermediate metal piece, two end metal pieces located at two opposite sides of the intermediate metal piece respectively, and two insulators each connected between the intermediate metal piece and one of the two end metal pieces. The antenna component includes an antenna body and a conductor. The antenna body includes a PCB board and a spring piece, a first end of the spring piece is connected to the PCB board. The conductor is connected to the insulator and the end metal piece. The conductor includes a first conductive portion and a second conductive portion. The first conductive portion is opposite to the insulator and abuts against a second end of the spring piece. The second conductive portion is connected to the first conductive portion and opposite to the end metal piece.

DETAILED DESCRIPTION

Figure 1:
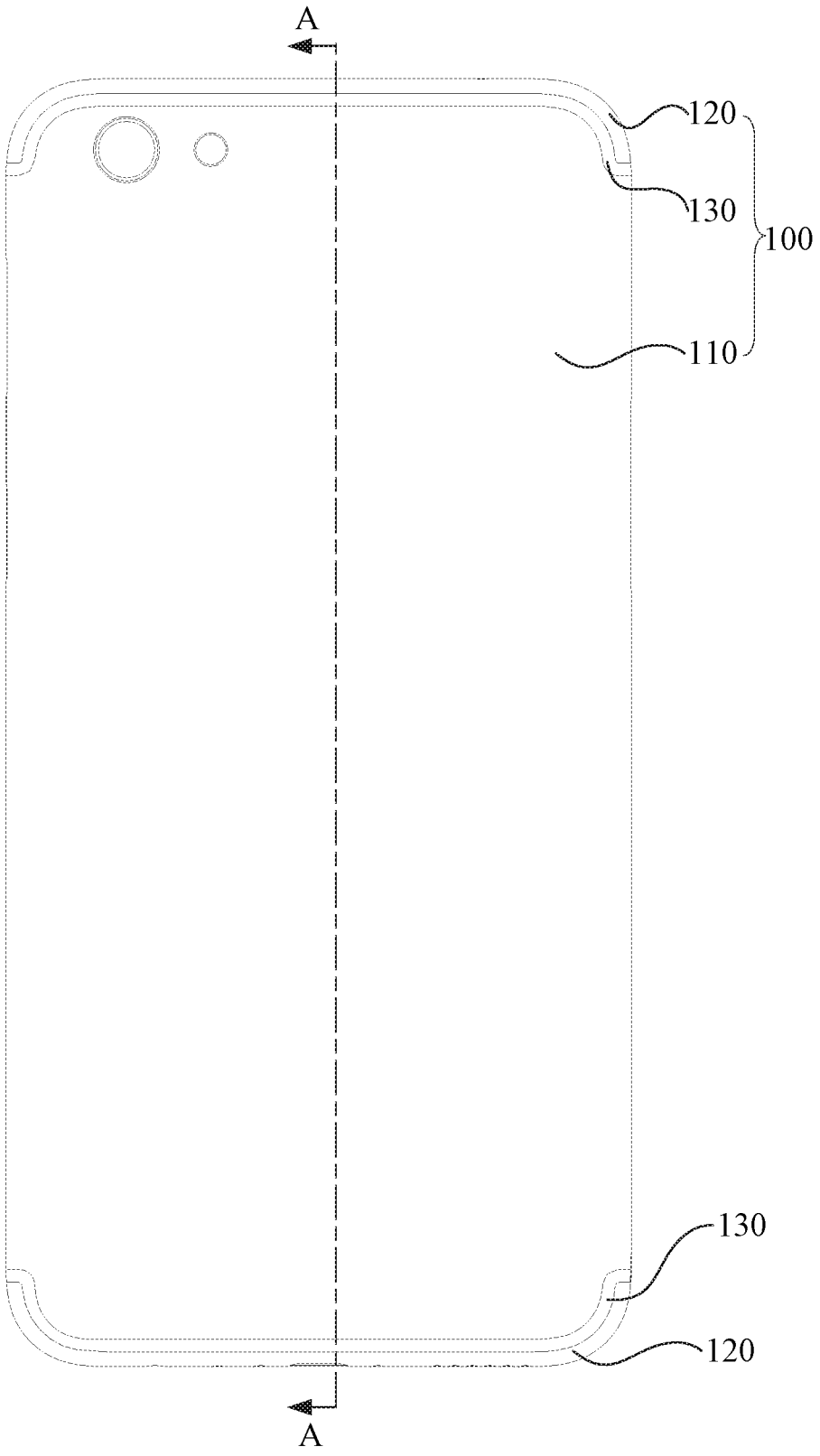
FIG. 1 is a schematic front view of a mobile phone according to an embodiment of the present disclosure.

Reference will be made in detail to embodiments of the present disclosure. The embodiments described herein with reference to drawings are explanatory, illustrative, used to generally and comprehensively understand the present disclosure, and shall not be construed to limit the present disclosure.

It is to be understood that, in the present disclosure, unless specified or limited otherwise, the terms "connected" and "fixed" and the like are used broadly, and may be, for example, direct connections or indirect connections via intervening structures, which can be understood by those skilled in the art according to specific situations. Terms such as "inside," "outside," "left," and "right," should be construed to refer to the orientation as then described or as shown in the drawings under discussion. These relative terms are for convenience of description and do not require that the present disclosure be constructed or operated in a particular orientation.

In an embodiment of the present disclosure, an antenna component includes an antenna body and a conductor. The antenna body includes a PCB board and a spring piece, a first end of the spring piece is connected to the PCB board. The conductor is configured to be connected to an insulator and an end metal piece. The conductor includes a first conductive portion and a second conductive portion. The first conductive portion is opposite to the insulator and abuts against a second end of the spring piece. The second conductive portion is connected to the first conductive portion and opposite to the end metal piece.

In an embodiment of the present disclosure, the first conductive portion is configured to be attached to the insulator, the second conductive portion is configured to be attached to the end metal piece, and the first conductive portion is perpendicular to the second conductive portion.

In an embodiment of the present disclosure, the conductor is a copper foil conductor.

In an embodiment of the present disclosure, a mobile terminal is provided. The mobile terminal includes a housing and an antenna component. The housing includes an intermediate metal piece, two end metal pieces located at two opposite sides of the intermediate metal piece respectively, and two insulators each connected between the intermediate metal piece and one of the two end metal pieces. The antenna component includes an antenna body and a conductor. The antenna body includes a PCB board and a spring piece, a first end of the spring piece is connected to the PCB board. The conductor is connected to the insulator and the end metal piece. The conductor includes a first conductive portion and a second conductive portion. The first conductive portion is opposite to the insulator and abuts against a second end of the spring piece. The second conductive portion is connected to the first conductive portion and opposite to the end metal piece.

In an embodiment of the present disclosure, the first conductive portion is attached to the insulator, the second conductive portion is attached to the end metal piece, and the first conductive portion is perpendicular to the second conductive portion.

In an embodiment of the present disclosure, the conductor is a copper foil conductor.

In an embodiment of the present disclosure, the insulator has a first mounting surface attached to the first conductive portion, and a vertical projection of the first conductive portion on the intermediate metal piece is located within a vertical projection of the first mounting surface on the intermediate metal piece.

In an embodiment of the present disclosure, the insulator includes a main portion, a first supporting portion and a second supporting portion. The main portion is located between the intermediate metal piece and the end metal piece. The first supporting portion is located on a first side of the main portion and attached to the intermediate metal piece. The second supporting portion is located on a second side of the main portion opposite to the first supporting portion and attached to the end metal piece.

In an embodiment of the present disclosure, the end metal piece has a stepped surface extending in a width direction of the end metal piece, and the second supporting portion is attached to the stepped surface.

In an embodiment of the present disclosure, a length of the first supporting portion is greater than that of the second supporting portion.

In an embodiment of the present disclosure, the first supporting portion and the second supporting portion are perpendicular to the main portion.

In an embodiment of the present disclosure, the end metal piece has a second mounting surface extending in a height direction of the end metal piece and opposite to the second conductive portion, and the second conductive portion is welded to the second mounting surface.

In an embodiment of the present disclosure, the insulator is a plastic insulator.

In an embodiment of the present disclosure, the first conductive portion is adhesively connected to the first mounting surface.

In an embodiment of the present disclosure, the main portion, the first supporting portion and the second supporting portion are integrally molded.

In an embodiment of the present disclosure, surfaces of the main portion, the first supporting portion, and the second supporting portion which are attached to the first conductive portion are flush.

Figure 2:
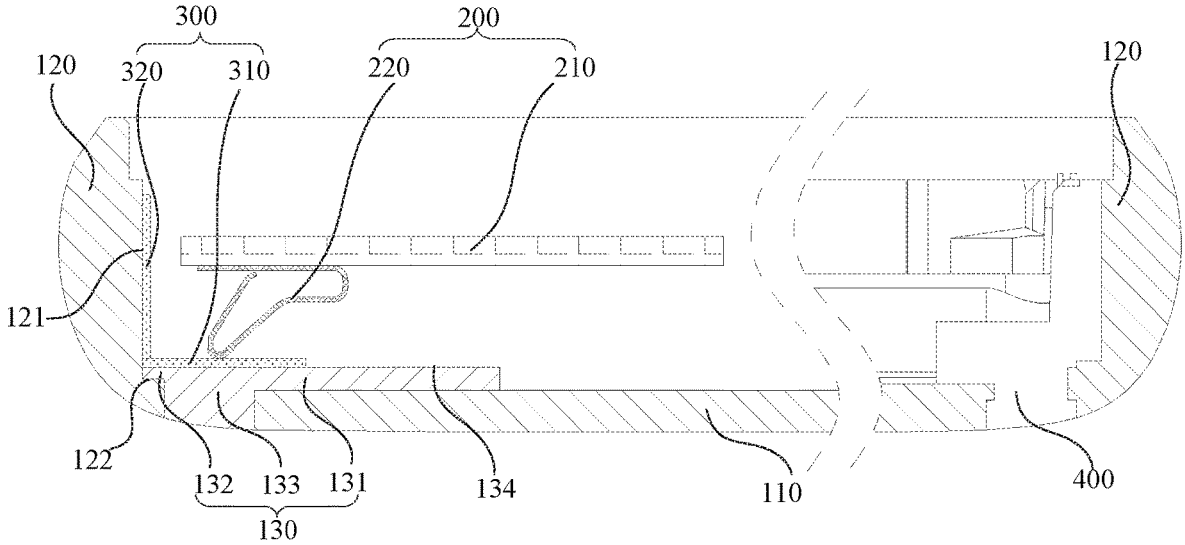
FIG. 2 is a schematic cross-sectional view of the mobile phone in FIG. 1 taken along line A-A.

Referring to FIG. 1 and FIG. 2, an antenna component is provided, which can be used in a mobile terminal device, such as a mobile phone. In particular, the antenna component includes an antenna body 200 and a conductor 300. A housing 100 is provided in the mobile terminal device. The housing 100 includes an intermediate metal piece 110, two insulators 130 and two end metal pieces 120. The intermediate metal piece 110 is located between the two end metal pieces 120. There is a certain gap 400 between the intermediate metal piece 110 and each of the two end metal pieces 120, and the insulator 130 is located in the gap 400, and the two insulators 130 connect the intermediate metal piece 110 and the two end metal pieces 120 to form an integral housing 100.

The antenna body 200 includes a PCB board 210 and a spring piece 220. A first end of the spring piece 220 is fixedly connected to the PCB board 210. The conductor 300 includes a first conductive portion 310 and a second conductive portion 320, the first conductive portion 310 is connected to the insulator 130, the second conductive portion 320 is connected to the first conductive portion 310 and fixed to the end metal piece 120, and a second end of the spring piece 220 abuts against the first conductive portion 310.

The housing 100 is divided into the intermediate metal section 110 and two end metal pieces 120, and the intermediate metal section 110 and the end metal piece 120 are connected by the insulator 130. Therefore, the housing 100 is not an integrally connected conductor, and thus cannot shield the antenna body 200. Meanwhile, the end metal piece 120 is conductively connected to the PCB board 210 successively via the second conductive portion 320, the first conductive portion 310, and the spring piece 220. In fact, the two end metal pieces 120 become part of the antenna and have a function of signal radiation.

A vertical section of the insulator 130 is approximately T-shaped. The insulator 130 includes a main portion 133, a first supporting portion 131 and a second supporting portion 132. The main portion 133, the first supporting portion 131 and the second supporting portion 132 are integrally molded, and the first supporting portion 131 and the second supporting portion 132 are vertically connected to the main portion 133. The first supporting portion 131 is located on a first side of the main portion 133, a first surface of the first supporting portion 131 is attached to the intermediate metal piece 110, and a second surface of the first supporting portion 131 is attached to the first conductive portion 310. The second supporting portion 132 is located on a second side of the main portion 133 opposite to the first supporting portion 131, a first surface of the second supporting portion 132 is attached to the end metal piece 120, and a second surface of the second supporting portion 132 is attached to the first conductive portion 310. In practice, the surfaces of the main portion 133, the first supporting portion 131, and the second supporting portion 132 which are attached to the first conductive portion 310 are flush so as to be integrally connected to form a first mounting surface 134. Specifically, the first conductive portion 310 is adhesively connected to the first mounting surface 134.

The end metal piece 120 has a stepped surface 122 extending in a width direction of the end metal piece 120, i.e., the stepped surface 122 is a horizontal plane, and the second supporting portion 132 is just attached to the stepped surface 122.

The end metal piece 120 has a second mounting surface 121 extending in a height direction of the end metal piece 120, that is, the second mounting surface 121 is a vertical plane, and the second mounting surface 121 and the stepped surface 122 are vertically connected to form an L-shaped structure. The second conductive portion 320 is mounted on the second mounting surface 121, and the second conductive portion 320 may be attached to the second mounting surface 121 by brazing or ultrasonic welding, thereby achieving a mechanical connection and a conductive connection of the second conductive portion 320 and the end metal piece 120.

The first conductive portion 310 and the second conductive portion 320 are vertically connected to form an L-shaped mechanism, and the first mounting surface 134 and the second mounting surface 121 are also perpendicular to each other. It will be understood that the first conductive portion 310 and the second conductive portion 320 may not be perpendicular to each other.

When the housing 100 is molded, PPS (polyphenylene sulfide) plastic or PBT (polybutylene terephthalate) plastic is injected into the gap 400 between the end metal piece 120 and the intermediate metal piece 110, and the insulator 130 described above is formed after the PPS plastic or PBT plastic is solidified. The end metal pieces 120 are located at the outmost edges of the upper and lower ends of the terminal device, such as a mobile phone, and thus have a small width. By providing the stepped surface 122 on the end metal piece 120, and attaching the second supporting portion 132 of the insulator 130 to the stepped surface 122, it is advantageous to increase the connection strength between the insulator 130 and the end metal piece 120 and thus to improve the impact resistance of the entire housing 100, thereby ensuring that the housing 100 will not be damaged when the terminal device (such as a mobile phone) drops.

Further, a vertical projection of the first conductive portion 310 on the intermediate metal piece 110 is located within a vertical projection of the first mounting surface 134 on the intermediate metal piece 110, that is, the first conductive portion 310 is only in contact with the first mounting surface 134, and completely located in and supported by the first mounting surface 134, thereby preventing the first conductive portion 310 from contacting with the intermediate metal piece 110. In such a case, the end metal piece 120 cannot be electrically connected to the intermediate metal piece 110 via the first conductive portion 310, and therefore the housing 100 does not play a shielding effect on the antenna body 200.

A length of the first supporting portion 131 is greater than that of the second supporting portion 132. Due to the limited width of the stepped surface 122, an appropriately increased length of the first supporting portion 131 may increase a contact area between the first supporting portion 131 and the intermediate metal piece 110 to improve the connection strength of the insulator to the end metal piece 120 and the intermediate metal piece 110, ensuring the impact resistance of the housing 100. In addition, the appropriately increased length of the first supporting portion 131 ensures that an end of the first conductive portion 310 away from the end metal piece 120 will not extend beyond an end of the first support portion 131, and thereby the first conductive portion 310 is prevented from contacting with the intermediate metal piece 110. Therefore, the end metal piece 120 cannot have a conductive connection relationship with the intermediate metal piece 110.

Specifically, the conductor 300 is a copper foil conductor 300. Of course, the conductor 300 may be made of other conductive materials with excellent electrical conductivity. By providing the conductor 300, a conductive connection between the spring piece 220 and the end metal piece 120 can be achieved, which allows the end metal piece 120 to be part of the antenna, without the spring piece 220 to directly abut against the end metal piece 120.

Specifically, the end metal piece 120 is conductively connected to the PCB board successively via the second conductive portion 320, the first conductive portion 310 and the spring piece 220. By a connection between the first conductive portion 310 provided horizontally and the second conductive portion 320 provided vertically, and the spring piece 220 directly abutting against the first conductive portion 310 horizontally provided, it is possible to solve the problem that the spring piece 220 cannot effectively abut against the end metal piece 120 in the horizontal plane due to the small width of the end metal piece 120, without the spring piece 220 to abut against the end metal piece 120 in the vertical plane, which simplifies the overall structure of the antenna, reduces the production cost and improves the assembling efficiency.

In an embodiment of the present disclosure, a mobile terminal device, such as a mobile phone, is provided. The mobile terminal device includes an antenna component and a housing 100 described hereinbefore, and will not be elaborated herein.

The technical features of the above-described embodiments can be arbitrarily combined. In order to make the description brief, not all possible combinations of the respective technical features in the above-described embodiments are described. As long as there is no contradiction in the combination of these technical features, it should be considered within the scope of present disclosure.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure. Therefore, the scope of the present disclosure should be subject to the appended claims.

What is claimed is:

1. An antenna component, comprising:

an antenna body, comprising a PCB board and a spring piece, a first end of the spring piece being connected to the PCB board; and a conductor configured to be connected to an insulator and an end metal piece, wherein the conductor comprises:

a first conductive portion opposite to the insulator and abutting against a second end of the spring piece; and a second conductive portion connected to the first conductive portion and configured to be conductively connected to the end metal piece, wherein the first conductive portion is configured to be perpendicular to an inner surface of the end metal piece;

wherein the insulator and the end metal piece are parts of a housing to which the antenna component is to be applied, and the second conductive portion is configured to attach to the end metal piece when the antenna component is assembled to the housing.

2. The antenna component according to claim 1, wherein the first conductive portion is configured to be attached to the insulator, and the second conductive portion is configured to be attached to the end metal piece, and the first conductive portion is perpendicular to the second conductive portion.

3. The antenna component according to claim 1, wherein the conductor is a copper foil conductor.

4. A mobile terminal, comprising a housing and an antenna component, wherein the housing comprises:

an intermediate metal piece, two end metal pieces located at two opposite sides of the intermediate metal piece respectively, and two insulators each connected between the intermediate metal piece and one of the two end metal pieces; and wherein the antenna component comprises:

an antenna body, comprising at least one PCB board and two spring piece, a first end of each of the two spring pieces being connected to the PCB board; and two conductors each connected to a respective one of the two insulators and a respective one of the two end metal piece, wherein each of the two conductors comprises:

a first conductive portion opposite to the insulator and abutting against a second end of a respective one of the two spring pieces; and a second conductive portion connected to the first conductive portion and conductively connected to a respective one of the two end metal pieces.

5. The mobile terminal according to claim 4, wherein, for each of the two conductors, the first conductive portion is attached to a respective one of the two insulators, and the second conductive portion is attached to the respective one of the two end metal pieces, and the first conductive portion is perpendicular to the second conductive portion.

6. The mobile terminal according to claim 4, wherein each of the two conductors is a copper foil conductor.

7. The mobile terminal according to claim 4, wherein each of the two insulators has a first mounting surface attached to the respective first conductive portion, and a vertical projection of the respective first conductive portion on the intermediate metal piece is located within a vertical projection of the first mounting surface on the intermediate metal piece.

8. The mobile terminal according to claim 4, wherein each of the two insulators comprises:

a main portion located between the intermediate metal piece and the respective one of the two end metal pieces, a first supporting portion located on a first side of the main portion and attached to the intermediate metal piece, and a second supporting portion located on a second side of the main portion opposite to the first supporting portion and attached to the respective one of the two end metal pieces.

9. The mobile terminal according to claim 8, wherein at least one of the two end metal pieces has a stepped surface extending in a width direction of the at least one of the two end metal pieces, and the second supporting portion is attached to the stepped surface.

10. The mobile terminal according to claim 8, wherein a length of the first supporting portion is greater than that of the second supporting portion.

11. The mobile terminal according to claim 8, wherein the first supporting portion and the second supporting portion are perpendicular to the main portion.

12. The mobile terminal according to claim 4, wherein at least one of the two end metal pieces has a second mounting surface extending in a height direction of the at least one of the two end metal pieces and opposite to the second conductive portion, and the second conductive portion is welded to the second mounting surface.

13. The mobile terminal according to claim 4, wherein at least one of the two insulators is a plastic insulator.

14. The mobile terminal according to claim 7, wherein the first conductive portion is adhesively connected to the first mounting surface.

15. The mobile terminal according to claim 8, wherein the main portion, the first supporting portion and the second supporting portion are integrally molded.

16. The mobile terminal according to claim 8, wherein surfaces of the main portion, the first supporting portion, and the second supporting portion which are attached to the first conductive portion are flush.

17. The mobile terminal according to claim 4, wherein the first conductive portion is insulated from the intermediate metal piece by the insulator opposite to the first conductive portion.

18. The antenna component according to claim 1, wherein the first conductive portion is configured to extend along a width direction of the end metal piece, and the second conductive portion is configured to extend along a height direction of the end metal piece.

19. The antenna component according to claim 1, wherein the first conductive portion and the second conductive portion are vertically connected to form an L-shaped mechanism.

* * * * *